US005447116A

United States Patent [19]

Kobayashi

[11] Patent Number: 5,447,116

[45] Date of Patent: Sep. 5, 1995

[54] PERSONAL WATERCRAFT

[75] Inventor: Noboru Kobayashi, Iwata, Japan

[73] Assignee: Yamaha Hatsudoki Kabushiki Kaisha, Iwata, Japan

[21] Appl. No.: 63,277

[22] Filed: May 18, 1993

[51] Int. Cl.[6] ..... B63B 35/86
[52] U.S. Cl. ..... 114/363
[58] Field of Search ..... 440/38; 441/65, 66, 441/67, 74, 79; 114/270, 363; 297/195.1

[56] References Cited

U.S. PATENT DOCUMENTS

| | | | |
|---|---|---|---|
| 3,791,335 | 2/1974 | Del Vecchio | 114/270 |
| 4,231,315 | 11/1980 | Tachibana et al. | 114/270 |
| 4,629,434 | 12/1986 | Monreal | 441/65 |
| 4,678,444 | 7/1987 | Monreal | 441/65 |
| 4,909,176 | 3/1990 | Kobayashi | 114/270 |
| 4,945,852 | 8/1990 | Kobayashi | 114/270 |

*Primary Examiner*—Stephen P. Avila
*Attorney, Agent, or Firm*—Knobbe, Martens, Olson & Bear

[57] ABSTRACT

A personal watercraft having a seat and foot arrangement that accommodates a rider either seated in an erect position or kneeling in a crouching position.

11 Claims, 5 Drawing Sheets

PERSONAL WATERCRAFT

BACKGROUND OF THE INVENTION

This invention relates to a personal watercraft and more particularly to an improved small type watercraft in which the operator may operate the watercraft from either of two non-standing positions.

There is a very popular type of small watercraft which is called a personal watercraft or water vehicle and which is designed to be operated primarily by a single rider. Most often, this type of watercraft is powered by a jet propulsion unit. For the most part, these types of watercraft fall into two general categories. The first type is designed to be operated primarily by the rider when standing on a rear deck of the watercraft. The other type is designed to be operated by the rider seated on the watercraft.

This invention deals primarily with the latter type of watercraft. Those watercraft previously proposed have generally required the operator to operate the watercraft in a generally upright seated position. However, there are times when the rider may wish to assume a different riding posture and particularly one where the rider can kneel or crouch so as to provide a low center of gravity, low wind resistance and more sporting operation of the water vehicle.

It is, therefore, a principal object of this invention to provide an improved small watercraft of the type that can be operated by a rider either sitting or kneeling.

It is a further object of this invention to provide a small watercraft that will afford several different riding positions for an operator one of which is more of a touring position and the other of which is more of a sporting position.

SUMMARY OF THE INVENTION

This invention is adapted to be embodied in a small watercraft having a hull defining a rider's area. A seat is provided in the rider's area and is configured to accommodate a rider in straddle fashion. A pair of leg areas are defined by the hull on opposite sides of the seat for accommodating the legs of a rider upon the seat. The leg area provides a forward foot area to support the feet of a seated rider and a rearward knee area to accept the knee of a rider kneeling on the seat.

DETAILED DESCRIPTION OF THE PREFERRED EMBODIMENTS OF THE INVENTION

Figure 1:
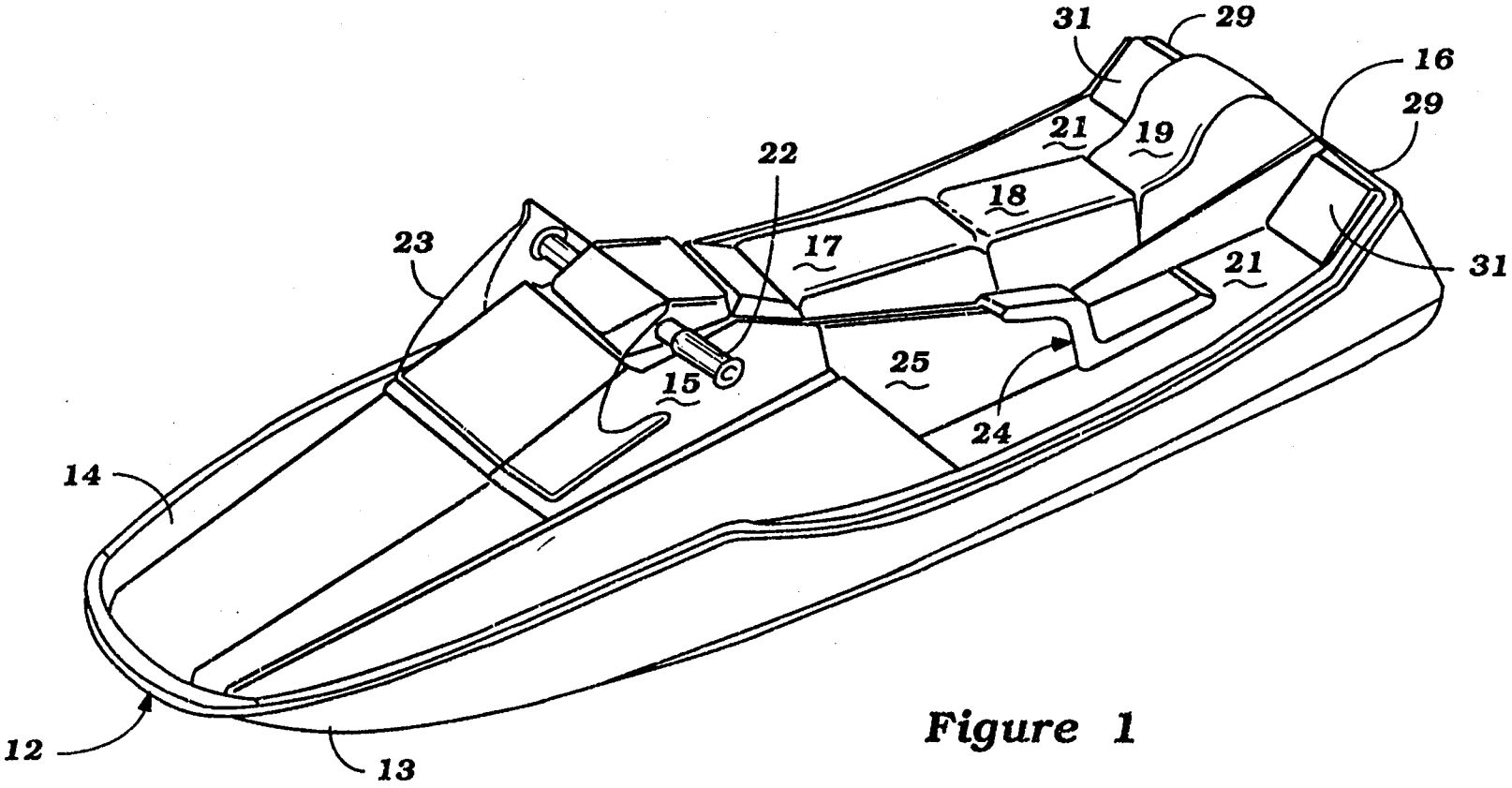
FIG. 1 is a perspective view of a small watercraft constructed in accordance with an embodiment of the invention, showing the optional windshield mounted.

A small watercraft constructed in accordance with an embodiment of the invention is identified generally by the reference numeral 11. The watercraft 11 includes a hull assembly, indicated generally by the reference numeral 12 that is comprised of a lower hull portion 13 and an upper deck portion 14. The hull portions 13 and 14 may be formed from any suitable material such as a molded fiberglass reinforced plastic or the like. Although it does not appear in the drawings, the forward portion of the hull 12 defines an engine compartment which is accessible through a removable hatch cover 15. An internal combustion engine of a known type is mounted in this engine compartment and drives a jet propulsion unit (not shown) positioned in a tunnel at the rear of the hull.

Figure 3:
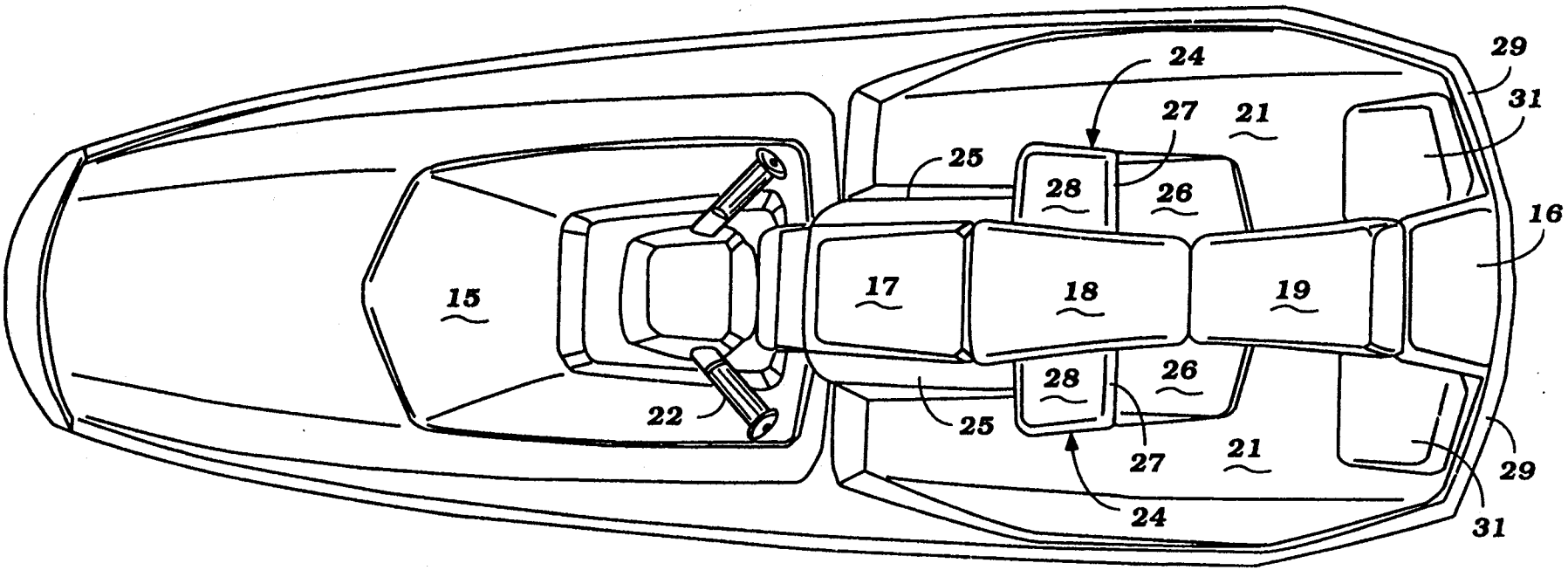
FIG. 3 is a top plan view of the watercraft.
Figure 4:
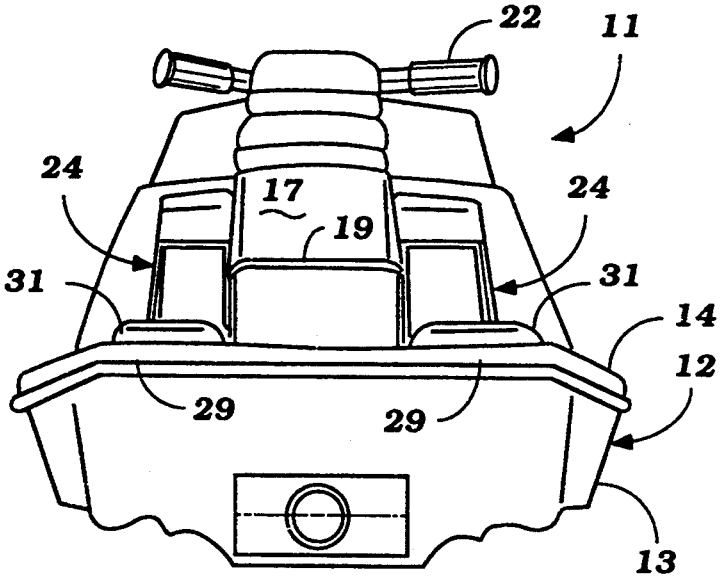
FIG. 4 is a rear elevational view of the watercraft.

The aforenoted tunnel is positioned beneath a raised area 16 of the hull deck portion 14 and upon which a seat cushion formed of three portions, a front portion 17, an intermediate portion 18 and a rear portion 19 is mounted. As may be seen in FIGS. 1 and 3, there is provided a generally open foot area 21 on either side of the raised hull portion 16 and seat cushion portions 17, 18 and 19.

A handlebar assembly 22 is provided forwardly of the rider's area where the seat cushions 17, 18 and 19 are positioned for steering of the jet propulsion unit discharge nozzle to steer the watercraft 12 and also to control the throttle of the powering internal combustion engine to control the speed. If desired, a removable windshield, illustrated only in FIG. 1 and identified by the reference numeral 23, may be mounted on the hatch cover 15 forwardly of the handlebar 22 to offer protection for the rider.

The mechanical details of the watercraft and the particular configuration of the hull 11 will not be described in any more detail because the invention deals with the rider's area including the seat cushion portions 17, 18 and 19 and the foot areas 21 so as to accommodate different riding postures for the rider. Thus, other details of the construction of the watercraft may be considered to be conventional and they may be of any form well known in this art.

In the foot areas and immediately adjacent the raised deck portion 16 there are provided a pair of knee pads, indicated generally by the reference numeral 24. The knee pads 24 are received on respective projections 25 formed on opposite sides of the hull and consist of a horizontally extending part 26 that is positioned in slightly raised relationship to the foot area 21, a vertically extending portion 27 and a further forwardly inclined portion 28. These knee cushions 24 are positioned close in to the seat and adjacent the seat cushion portion 18.

Figure 2:
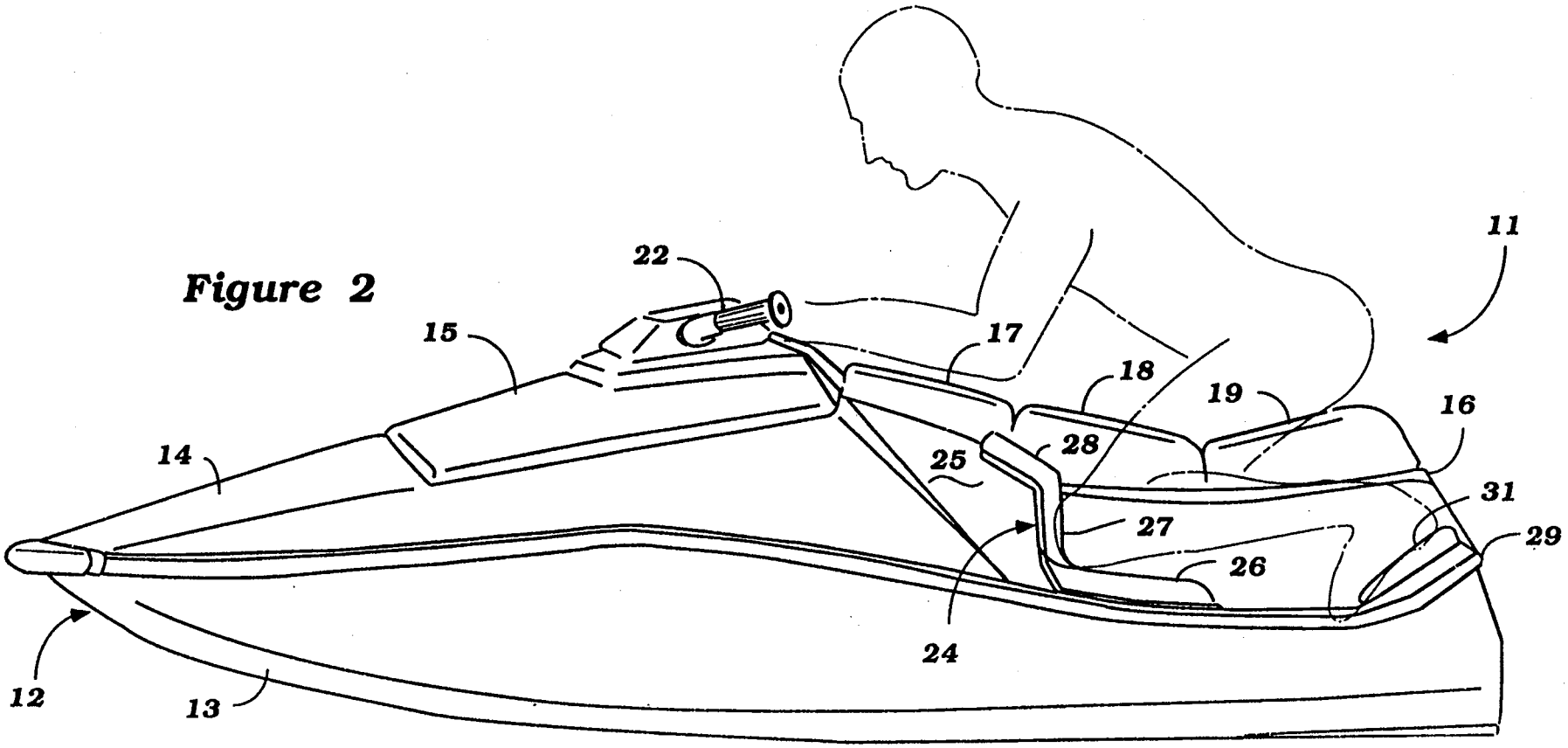
FIG. 2 is a side elevational view of the watercraft in an enlarged scale showing the rider in a kneeling fashion and with the optional windshield removed.

At the rear of the foot area 21, the deck portion has a raised transom 29 that has a forwardly facing surface that receives a pair of foot cushions 31. The knee cushions 24 and foot cushions 31 may be formed from a softer more pliable material than the remainder of the hull. As may be seen in FIG. 2, for sport riding the rider, shown in phantom in this figure, can sit on the rear seat portion 19, place his knees on the knee cushions 24 and his feet on the foot cushions 31 so as to assume a crouched, kneeling, riding position that will offer a low center of gravity and permit more sporting riding. Because the rider is able to wedge his legs between the knee cushions 24 and the foot cushions 31 and can grasp the raised area 16 between his legs, he will have a very good tight feel of the watercraft 11.

Figure 5:
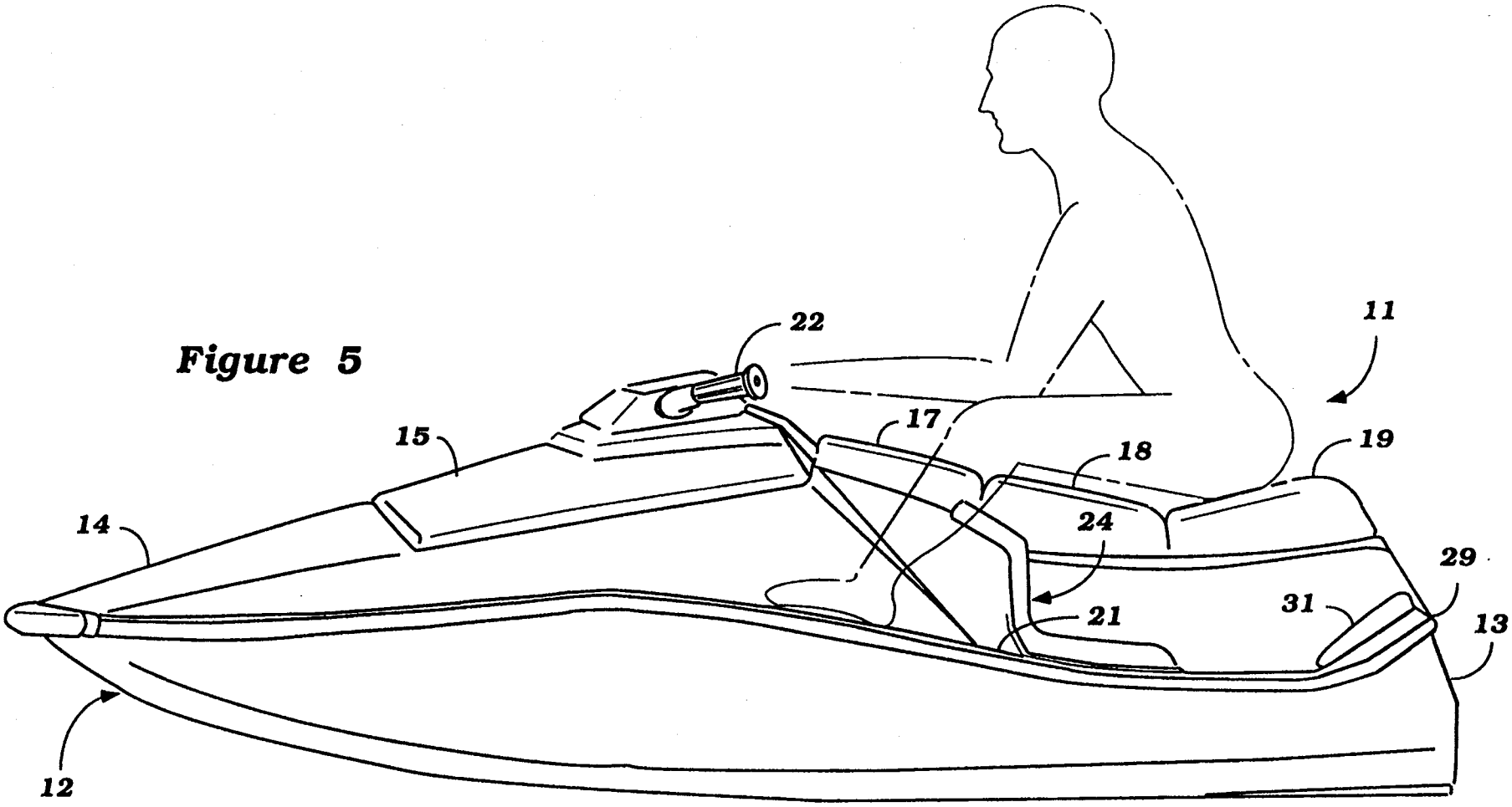
FIG. 5 is a side elevational view in part similar to FIG. 2, and shows the rider operating the watercraft in a seated fashion.

Alternatively, and for more cruising type riding, the rider may sit on the rear seat cushion portion 19 in a more erect position and place his legs at the forward portion of the foot area 21 outwardly of the knee cushions 24. The forward foot portion 21 is inclined upwardly so as to offer a more comfortable riding position as clearly shown in FIG. 5.

Therefore, it should be readily apparent that the described water vehicle construction permits a pair of quite different riding postures to be assumed by the rider and affords comfort and good feel in each riding position.

It is to be understood that the foregoing description is that of a preferred embodiment of the invention and that various changes and modifications may be made without departing from the spirit and scope of the invention, as defined by the appended claims.

I claim:

1. A small watercraft having a hull defining a rider's area, a seat in said rider's area configured to accommodate a rider in straddle fashion, a control for said watercraft positioned forwardly of said seat and at a height not substantially above said seat, and a pair of leg areas defined by said hull on opposite sides of said seat for accommodating the legs of a rider upon said seat, said leg [area]areas each providing respective horizontally extending foot area to support the foot of a rider when seated in a sitting position on said seat and operating said control from the seated position and a raised knee area to the rear of and separate from said foot area and vertically above said floor area to accept the knees of a rider kneeling on said seat and operating said control from the kneeling position, said seat being at a height relative to said foot and knee areas to permit a rider to assume either a sitting or a kneeling position while on said seat.

2. A small watercraft having a hull defining a rider's area, a seat in said rider's area configured to accommodate a rider in straddle fashion, a control for said watercraft positioned forwardly of said set and at a height not substantially above said seat, and a pair of leg areas defined by said hull on opposite sides of said seat for accommodating the legs of a rider upon said seat, said leg area providing a foot area to support the foot of a rider when seated in a sitting position on said seat and operating said control from the seated position and a knee area to the rear of said foot area to accept the knees of a rider kneeling on said seat and operating said control from the kneeling position, said seat being at a height relative to said leg areas to permit a rider to assume either a sitting or a kneeling position while on said seat, said knee area being defined by a knee cushion having a horizontally extending portion and a vertically extending portion disposed at an angle to said horizontally extending portion and adapted to accommodate the knee of the rider.

3. A small watercraft as set forth in claim 2 further including a pair of foot supports disposed on opposite sides of said seat at the rear of said foot area and adapted to be engaged by and brace the feet of the rider whose knees are in the knee area.

4. A small watercraft as set forth in claim 3 wherein the knee area is disposed inwardly closely adjacent the sides of the seat and the foot area is disposed outwardly of the knee area and has an upwardly inclined portion.

5. A small watercraft as set forth in claim 1 wherein the seat is comprised of a forward, downwardly rearwardly inclined portion extending from about the height of the control and a rearward upwardly inclined portion with the forward portion extending immediately rearwardly of the controls.

6. A small watercraft as set forth in claims 5 wherein the knee area is defined by a knee cushion having a horizontally extending portion and a vertically extending portion disposed at an angle to said horizontally extending portion and adapted to accommodate the knee of the rider.

7. A small watercraft as set forth in claim 6 further including a pair of foot supports disposed on opposite sides of said seat at the rear of said foot area and adapted to be engaged by and brace the feet of the rider whose knees are in the knee area.

8. A small watercraft as set forth in claim 7 wherein the knee area is disposed inwardly closely adjacent the sides of the seat and the foot area is disposed outwardly of the knee area and has an upwardly inclined portion.

9. A small watercraft as set forth in claim 1, wherein the foot areas extend from a point forwardly of the knee areas along the sides of the knee areas and terminating to the rear of the knee areas.

10. A small watercraft having a hull defining a rider's area, a seat in said rider's area configured to accommodate a rider in straddle fashion, a control for said watercraft positioned forwardly of said seat and at a height not substantially above said seat, and a pair of leg areas defined by said hull on opposite sides of said seat for accommodating the legs of a rider upon said seat, said leg area providing a foot area to support the foot of a rider when seated in a sitting position on said seat and operating said control from the seated position and a knee area to the rear of said foot area to accept the knees of a rider kneeling on said seat and operating said control from the kneeling position, said seat being at a height relative to said leg areas to permit a rider to assume either a sitting or a kneeling position while on said seat, said knee area being defined by a knee cushion having a horizontally extending portion and a vertically extending portion disposed at an angle to said horizontally extending portion and adapted to accommodate the knee of the rider.

11. A small watercraft as set forth in claim 10 further including a pair of foot supports disposed on opposite sides of said seat at the rear of said foot area and adapted to be engaged by and brace the feet of the rider whose knees are in the knee area.

* * * * *